United States Patent [19]

Brunet

[11] Patent Number: 5,031,800

[45] Date of Patent: Jul. 16, 1991

[54] PUSHER AND CASE ASSEMBLY WITH A GUARANTEE SYSTEM

[75] Inventor: Michel Brunet, La Commanderie, France

[73] Assignee: Valois, Le Neubourg, France

[21] Appl. No.: 559,537

[22] Filed: Jul. 23, 1990

Related U.S. Application Data

[63] Continuation of Ser. No. 301,787, Jan. 26, 1989, abandoned.

[30] Foreign Application Priority Data

Jan. 27, 1988 [FR] France ..... 88 00916

[51] Int. Cl.[5] ..... B67D 5/64

[52] U.S. Cl. ..... 222/153; 222/162; 128/200.23

[58] Field of Search ..... 222/153, 162; 128/200.23, 203.22

[56] References Cited

U.S. PATENT DOCUMENTS 2,914,222 11/1959 Meshberg ..... 222/162
4,513,890 4/1985 Goncalves ..... 222/153

FOREIGN PATENT DOCUMENTS 286326 5/1966 Australia ..... 128/200.23
0131501 1/1985 European Pat. Off. ..... 128/200.23

*Primary Examiner*—H. Grant Skaggs
*Attorney, Agent, or Firm*—Sughrue, Mion, Zinn, Macpeak & Seas

[57] ABSTRACT

Tamperproof packaging for a spray device (1) of very small size constituted by a can (2) whose diameter and height are no more than a few centimeters and having a valve (3) actuatable by a hollow rod (4). The packaging has an open-topped case (13) having a bottom and a side wall, the bottom including an opening (15) which is wide enough to pass the finger of a user, but which is too narrow to pass the spray device (1). The packaging also has a pusher (5) constituted by a thrust cylinder (6) having an outside channel having one end which communicates with the outside and having its other end engaged by abutment over the rod (4) of the valve (3). The package has an outer envelope (8) which is fixed to the thrust cylinder (6) and which provides a surface suitable for receiving pressure from two other fingers of a user. The outer envelope (8) of the pusher (5) has a skirt (9) capable of engaging the open top of the case (13) and being nonreversibly fixed to the case; and the opening (15) in the bottom of the case (13) is initially closed by a cover which is easily torn off by hand.

5 Claims, 4 Drawing Sheets

PUSHER AND CASE ASSEMBLY WITH A GUARANTEE SYSTEM

This is a continuation of application Ser. No. 07/301,787 filed Jan. 26, 1989, now abandoned.

The present invention relates to packaging various spray devices which are used, in particular, in pharmacology.

BACKGROUND OF THE INVENTION

A spray device of this type comprises a can which is closed by a valve body including a small valve member held in a closed position at rest by a spring. When the valve rod is pushed into the can of the spray device, its contents escapes. Depending on requirements, when continuous pressure is exerted on the valve rod, a permanent aerosol jet or merely a single dose is released. The invention is applicable to all kinds of valve, including pumps. The requirement is for such spray devices to be presented in packaging which serves not only to facilitate subsequent use thereof, but which also serves initially to prove that the device has not been used by anybody else.

In general, the problem of making such spray devices easy to use and the problem of ensuring that they have not been used before are solved in different ways. Thus, pushers having a wide variety of shapes are fitted over the valve body and engage the valve rod internally, e.g. for the purpose of pushing the valve rod merely by applying index-finger pressure. Simultaneously, metal or plastic seals may be disposed around the spray orifice. Although it would not be impossible to design a seal for a non-removeable pusher, the corresponding product would not necessarily be easy to prepare. This drawback is particularly burdensome for a pharmaceutical laboratory which seeks to package spray devices easily for commercialization purposes once they have been filled with medical preparations.

SUMMARY OF THE INVENTION

The present invention provides tamperproof packaging for a spray device of very small size constituted by a can whose diameter and height are no more than a few centimeters and which is closed by a valve actuatable by pushing a hollow rod into said valve, said packaging comprising:

1) an open-topped case having a bottom and a side wall, said bottom including an opening which is wide enough to pass the finger of a user, but which is too narrow to pass the said spray device; and 2) a pusher constituted by a thrust cylinder having an inside channel having one end which communicates with the outside and having its other end engaged by abutment over said rod of said valve, and also having an outer envelope which is fixed to said thrust cylinder and which provides a surface suitable for receiving pressure from two other fingers of a user;

said outer envelope of said pusher also including a skirt capable of engaging the open top of said case for the purpose of being fixed thereto by non-reversible fixing means; and said opening in the bottom of said case being initially closed by a cover which is easily torn off by hand.

BRIEF DESCRIPTION OF THE DRAWINGS

Embodiments of the invention are described by way of example with reference to the accompanying drawings, in which.

MORE DETAILED DESCRIPTION

Figure 1:
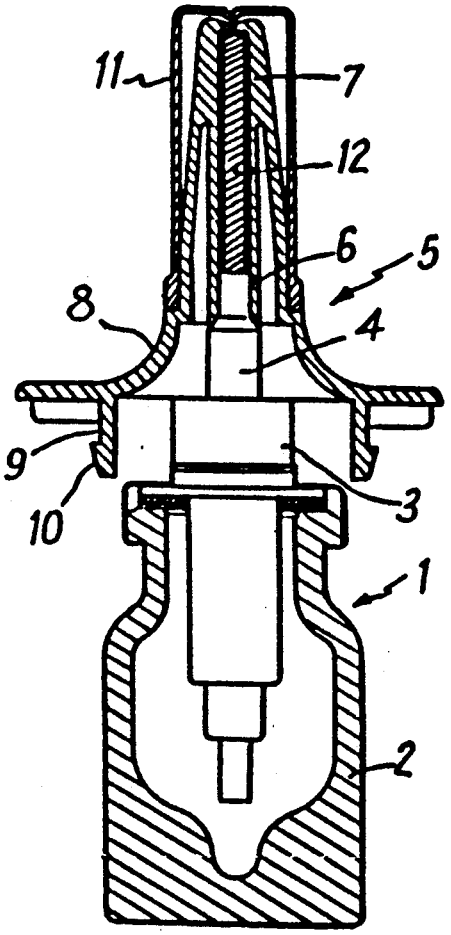
FIG. 1 is a vertical section through a spray device and a pusher in accordance with the invention, showing these two items after they have been connected together.

In the embodiment shown in FIG. 1, a spray device 1 comprises a can 2 and a valve 3 which is shown covered by a pusher 5 of the invention. The valve rod 4 of the spray device has a shoulder such that its top end is of smaller cross-section than the remainder thereof. A thrust cylinder 6 is engaged over the valve rod and comes into abutment against the shoulder. The cylinder 6 is an integral part of the pusher 5. When a vertical force is directed downwards (as shown in FIG. 1) on the pusher 5 by any means Whatsoever, the cylinder 6 imparts downwards motion to the valve rod 4. The rod is pushed into the valve body 3 of the spray device providing the body is held in place by some other means. The amplitude of the stroke of the valve rod 4 is determined by the inside shape of the base 8 of the pusher which determines how far the valve body 3 can be engaged therein.

If the stroke of the rod 4 is sufficient, the substance contained in the can 2 of the spray device escapes via the valve rod 4. It then flows along the inside of a spray nozzle 7. In the embodiments shown in the various figures, the spray nozzle 7 is elongate, its central cavity includes an accelerator device 12 for accelerating droplets of the substance, and the nozzle is protected by a push-fit cap 11. All of these characteristics specific to the spray nozzle 7 could be different (e.g. it could be shorter in length, its cavity could be empty, the cap could be screwed on, the spray could be directed sideways, etc.). The example shown is a nose spray. The invention is applicable to any kind of spray, e.g. a mouth spray.

Similarly, the vertical rim 9 on the pusher 5 could be fixed beneath its base 8 at various different distances from its periphery. The variant shown in FIG. 7 has the rim 9' right at the periphery of the base. In either case, the rim constitutes a complete ring, and its section is constituted by a latching hook shape with its hook 10 outwardly directed.

Figure 2:
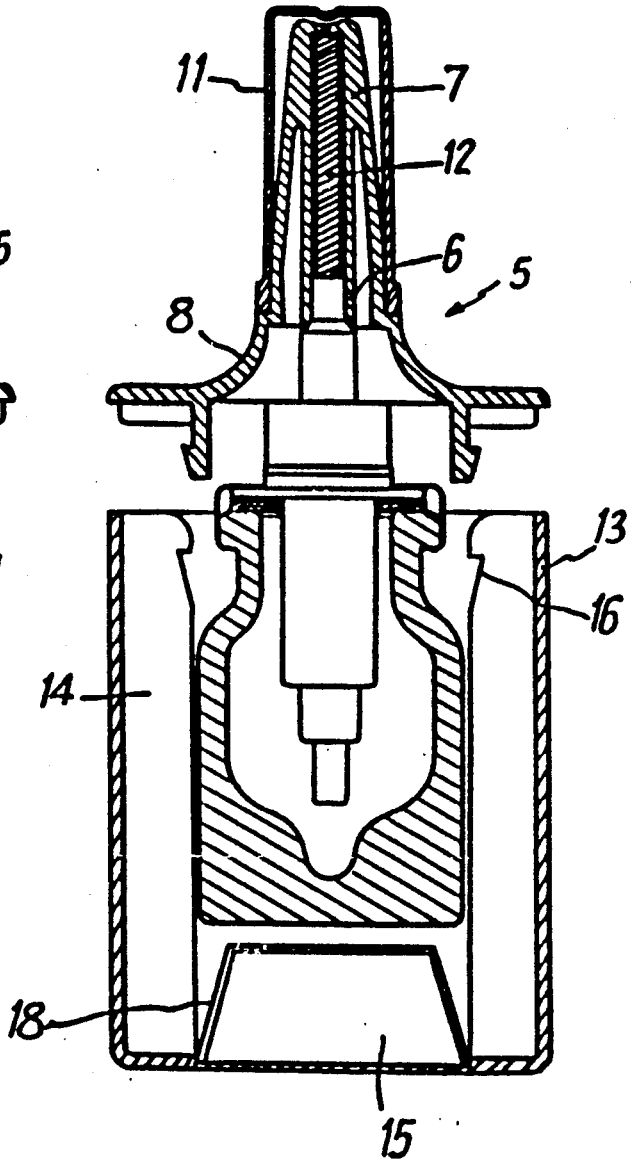
FIG. 2 is a section similar to FIG. 1 but also showing a vertical section through one embodiment of a case in accordance with the invention, shown partially engaged on the can of the spray device.
Figure 2A:
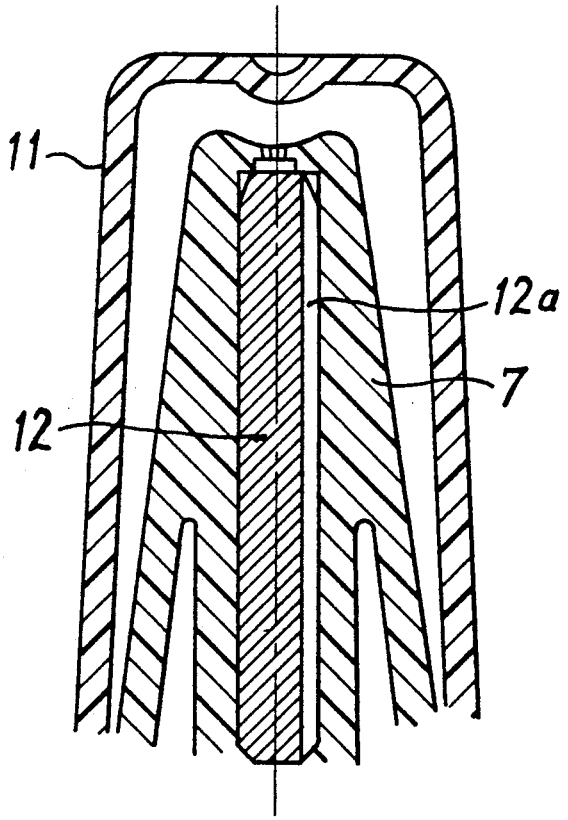
FIG. 2A is an enlarged partial view of the spray device showing on external surface groove 12*a* in filler piece 12.
Figure 3:
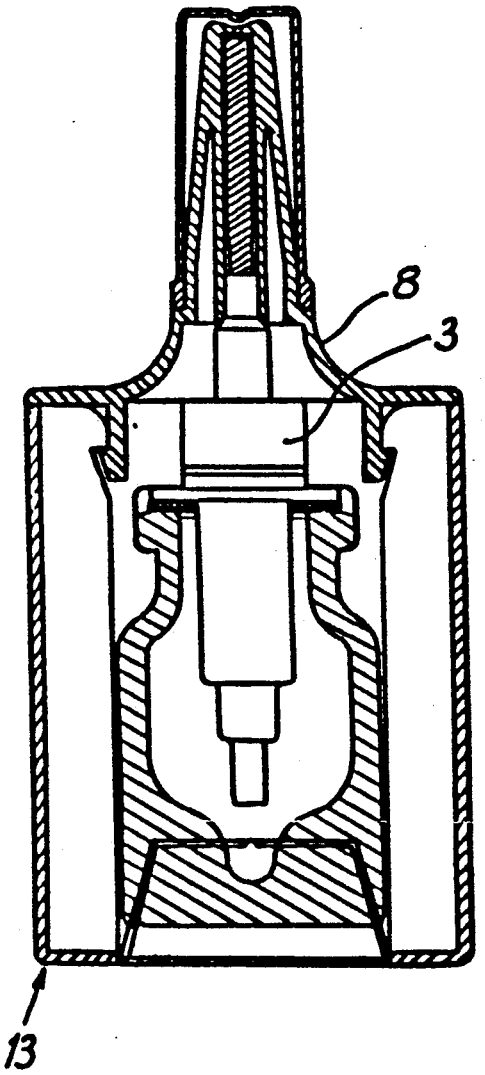
FIG. 3 is a vertical section of a complete packaging assembly in accordance with the invention containing the spray device after the pusher and the case have been snap-fastened together.
Figure 4:
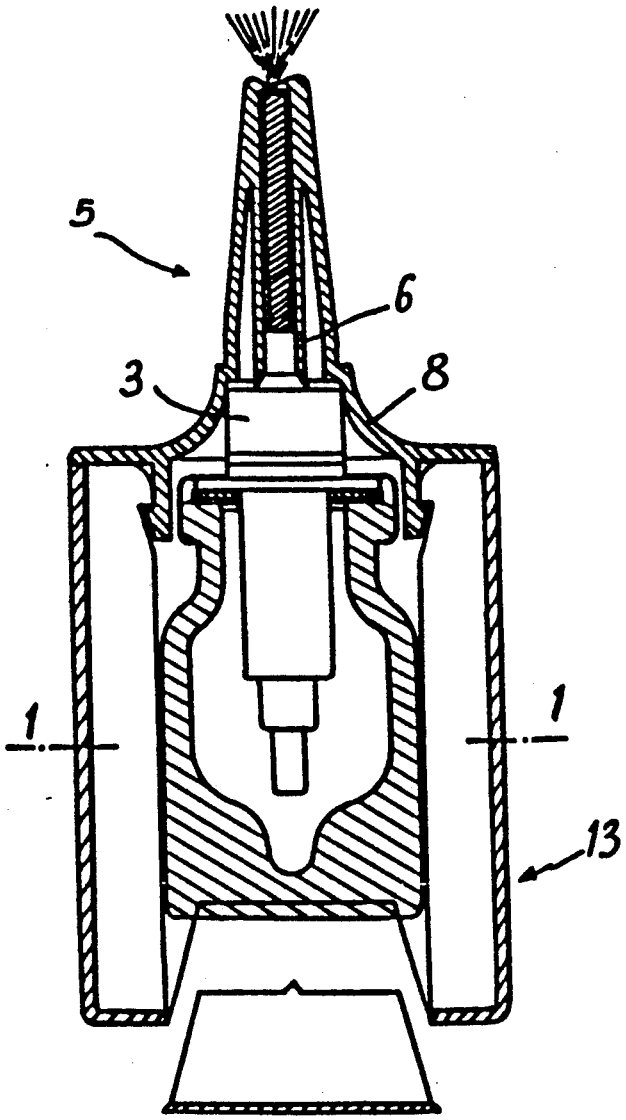
FIG. 4 is a further vertical section through the same components showing their relative positions during spraying.
Figure 5:
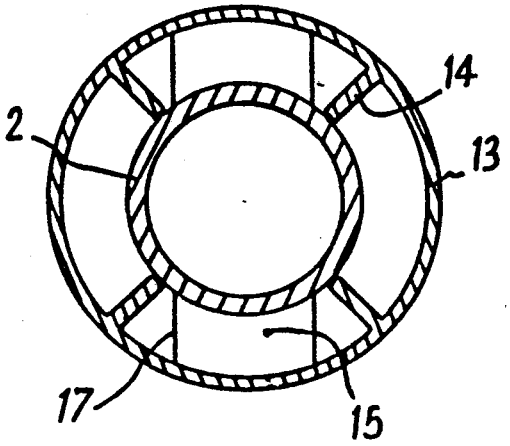
FIG. 5 is a horizontal cross-section on line 1—1 of FIG. 4 through the case and the can of the embodiment shown in FIGS. 1 to 4.
Figure 7:
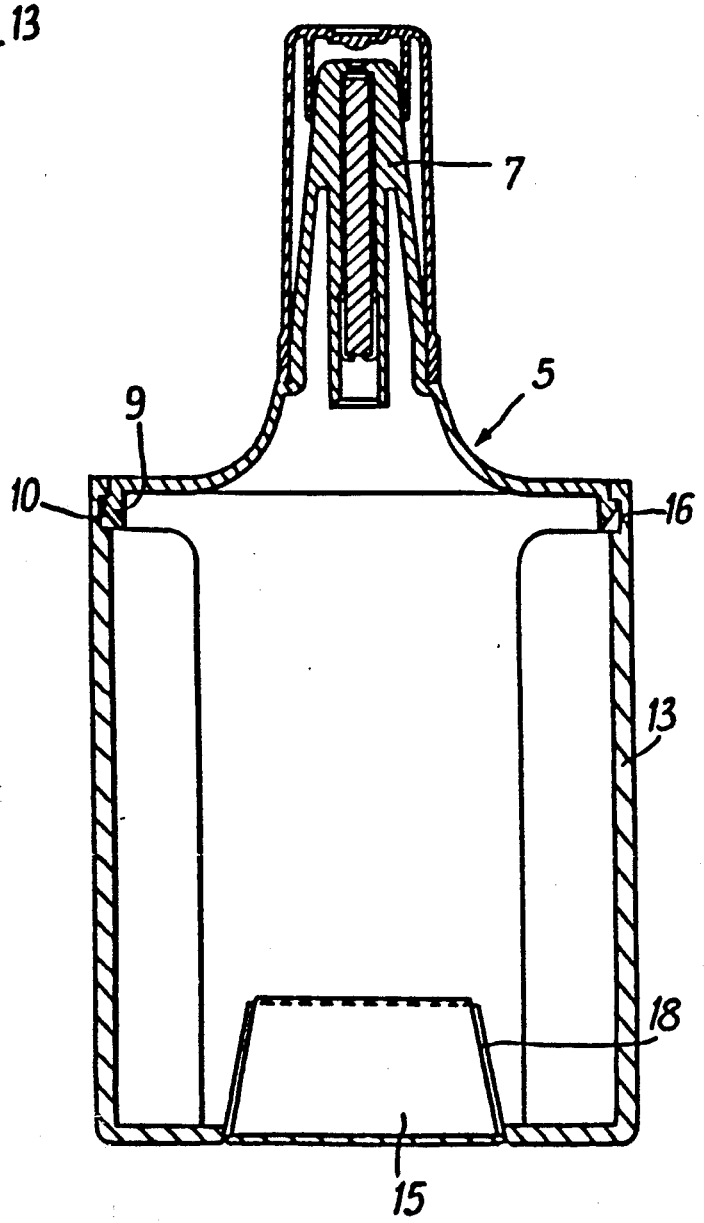
FIG. 7 is a vertical section through a variant pusher and case assembly in accordance with the invention.
Figure 6:
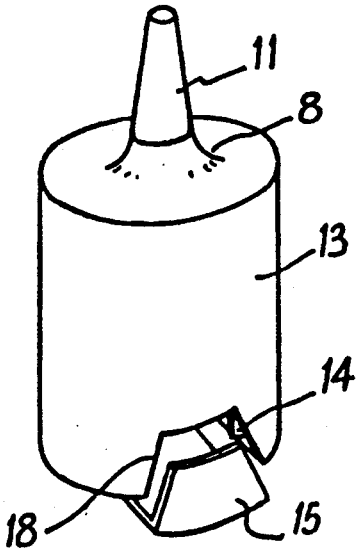
FIG. 6 is a perspective view of the pusher and case assembly of the invention in accordance with the embodiment shown in FIGS. 1 to 4 after the spray device has already been used.

Compared with FIG. 1, FIG. 2 also shows the section of a case in accordance with the invention. The case is constituted by a cylindrical housing with three special features. Firstly its inside wall includes vertical ribs 14 at radial intervals. The height, width, and number of the ribs are such that the can 2 of the spray device once inserted in the case 13 is held centrally on the axis of the case. FIG. 5 shows an embodiment having four ribs. Secondly, the bottom of the case is precut along two parallel straight lines 17 at equal distances from the axis of the system (see also FIG. 5). This distance is suitable for enabling a thumb to pass between the lines. However, the distance is less than the diameter of the can 2. The vertical walls of the case 13 are also precut at the ends of the bottom precut portion. The shape of the precut portion at each end can be seen at 18 in FIG. 2 and is further described below with reference to FIG. 6. Thirdly, one or more notches constituting hooks 16 are made in the upper portion of the case 13. These notches may be formed in the radially inside edges of the ribs as shown in FIGS. 2 to 4 or they may be formed in the inside wall of the case 13 as shown in the embodiment of FIG. 7.

In any event, the hooks 16 of the case 13 are at such a distance from the axis of revolution of the various parts as to engage the hooks 10 on the pusher 5 so that the case and the pusher can be snap-fastened together without using excessive force. FIG. 3 shows the respective positions of the various components after snap-fitting. The spray device is then protected from all sides. This protection is made tamperproof by the non-reversible nature of the snap-fastening. This is guaranteed both by the shape and dimensions of the parts and also by the choice of materials from which they are made. If an attempt is made to separate the pusher 5 from the case 13, then the hooks 10 or 16 will shear.

In a variant, not shown, the pusher may be welded, e.g. ultrasonically, to the case. This makes it impossible to open the packaging without destroying it.

In order to use the spray device 1, the cut-out 17 situated at the bottom of the case 13 must be broken off. If the cutting-out is performed is performed appropriately so as to leave lines of sufficient weakness, the cut-out 17 can be removed by exerting manual pressure between the two precut straight lines along the bottom of the case. The clearance between the bottom of the case and the bottom of the spray device facilitates obtaining the necessary shear forces. Once the opening has been disengaged in this manner, it is too narrow to allow the spray device to pass but it must be wide enough to allow a finger, and preferably the thumb, to be inserted to gain access to the spray device. This requirement means that it is also necessary to provide precut end portions 18 in the walls of the case 13 so that the final shape of the opening is that of a notch 15 or of a trench. This is better seen in the perspective view of FIG. 6.

Finally, FIG. 4 shows the spray device and its packaging while a spraying operation is taking place. As can be seen from the above description, spraying occurs when the bottom of the can is pressed manually, generally by means of the thumb. The packaging can then be held by means of two other fingers located on the base 8 of the pusher. Depending on the size of the spray device relative to the hand of an adult, it is necessary to provide a base of greater or lesser relative size in order to facilitate grasping.

In the context of its pharmaceutical application, pushers and cases of the invention may be delivered separately. After spray devices have been assembled and filled, there is no difficulty in fitting their valve rods in appropriate pushers, in placing their cans in appropriate cases, and then in snap-fastening together the two portions of the packaging, or alternatively in welding them together. The assembly which is then as shown in FIG. 3 is ready for distribution to sales outlets and to users. In addition to reassuring users that a spray device has not yet been used, the packaging also provides additional protection against shock and light, both of which may be applied to the spray device during transport and storage. Finally, the packaged spray device is easier to handle, particularly if the spray device on its own is very small.

I claim:

1. Tamperproof packaging for a spray device of very small size constituted by a can which can be held between the fingers of a hand and which is closed by a valve actuatable by pushing a hollow rod into said valve, said packaging comprising:

1) an open-topped case comprising a bottom and a side wall, said bottom including an opening which is wide enough to pass the finger of a user, but which is too narrow to pass said spray device, said side wall of said case including internal ribs with said can of said spray device being engaged therebetween; and 2) a pusher being constituted by a thrust cylinder having an inside channel, one end of which communicates with the outside and the other end of which is engaged by abutment over said rod of said valve, and also having an outer envelope which is fixed to said thrust cylinder and which provides a surface suitable for receiving pressure from two other fingers of a user;

said outer envelope of said pusher comprising a skirt sized to cover the open top of said case and carrying outwardly directed hooks co-operating with inwardly directed hooks formed in said ribs of said case so as to snap-fasten said skirt to said open top; and said opening in the bottom of said case being initially closed by a cover which is easily torn off by hand.

2. Packaging according to claim 1, wherein said pusher is protected by a removeable cap.

3. Packaging according to claim 1, wherein said spray device, said case, and said pusher are circularly symmetrical about a common vertical axis passing through the center of the bottom of said case.

4. Packaging according to claim 3, wherein said cover over the bottom of said case is in the form of a strip which is disposed symmetrically about a diameter of said bottom of said case, and wherein said strip communicates with at least one notch in said side wall of said case.

5. Packaging according to claim 1, wherein said thrust cylinder receives a filler piece inside its internal channel, said filler piece being provided with at least one external surface groove so as to leave only a narrow passage to the outside.

* * * * *